United States Patent [19]

Pearl

[11] 4,034,636

[45] July 12, 1977

[54] METHOD AND APPARATUS FOR PLACING A MULTI-PLY LAYUP OF SHEET MATERIAL ON A WORK TABLE

[75] Inventor: David R. Pearl, West Hartford, Conn.

[73] Assignee: Gerber Garment Technology, Inc., East Hartford, Conn.

[21] Appl. No.: 596,418

[22] Filed: July 16, 1975

[51] Int. Cl.[2] ..... B26D 7/06; B65H 35/00

[52] U.S. Cl. ..... 83/401; 83/925 CC; 83/417; 83/374; 83/405; 83/437; 214/1 BB; 198/626; 83/29

[58] Field of Search ..... 83/374, 29, 417, 404, 83/401, 925 CC, 405, 437; 214/1 BB, 8.5 C; 198/139, 218

[56] References Cited

U.S. PATENT DOCUMENTS

| | | | |
|---|---|---|---|
| 3,642,154 | 2/1972 | Duszka | 198/218 X |
| 3,701,299 | 10/1972 | Stumpf | 83/925 CC X |
| 3,790,071 | 2/1974 | Estephanian | 83/925 CC X |
| 3,826,170 | 7/1974 | Jones et al. | 83/925 CC X |

*Primary Examiner*—Donald R. Schran
*Attorney, Agent, or Firm*—McCormick, Paulding & Huber

[57] ABSTRACT

A lay table is placed adjacent to a cutting table with the tables in end-to-end relationship so that layups of limp sheet material may be prepared on the lay table and then be moved onto the cutting table for a cutting operation. A sled formed by a low friction, non-stretching, sheet material is first placed on the lay table and the layup is then formed on top of the sled. Motor-driven cabling extends between the cutting table and the lay table and when a layup is to be moved, the sled is coupled to the cabling and pulled by the cabling with a layup thereon onto the cutting table. The layup on the cutting table is then clamped in position, and the cabling pulls the sled out from between the layup and the cutting table.

11 Claims, 6 Drawing Figures

METHOD AND APPARATUS FOR PLACING A MULTI-PLY LAYUP OF SHEET MATERIAL ON A WORK TABLE

BACKGROUND OF THE INVENTION

The present invention relates to method and apparatus for placing layups of sheet material on the support surface of a cutting or other work table in preparation for a cutting or other work operation. More particularly, the present invention relates to method and apparatus for moving pre-formed layups of limp sheet material onto the work table by means of a sled and then removing the sled once the layup is in its proper position for working.

Automation has greatly improved the speed, accuracy and economics of cloth cutting and other work processes to the the point where material-handling procedures before and after the work process become materially significant to overall output. In manufacturing garments, upholstery and many other products made from limp sheet material, a multi-ply layup of the limp sheet material is generally cut by means of a machine having a tool head including a reciprocating knife blade which penetrates through the layup and translates along cutting paths under computer control. One such automatically controlled cutting machine is disclosed in U.S. Pat. No. 3,495,492 having the same assignee as the present invention. In the patented machine, the tool head is translated by carriages in two coordinate directions over the penetrable support surface of a cutting table on which the layup is firmly held during the cutting operation. The penetrable surface may be constructed from blocks of foamed plastic or bristled mats so that the reciprocating knife blade can penetrate entirely through the layup of limp sheet material without damage. For a more detailed description of the cutting machine, and its operation, reference may be had to the mentioned patent.

It will be recognized that the time required to form or generate a layup on the support surface of the cutting table steals from the useful operating time of the cutting machine. The sheet material is formed in the layup on the table by spreading one ply on top of another, and during the spreading operation, the cutting tool head and supporting carriages cannot operate and are parked at a rest position on the cutting table.

More economical use of the tool head, the carriages and the numerical controllers which govern or regulate the operation of the tool head on the cutting table can be achieved by providing several different cutting tables for each tool head and controller; and by transferring the tool head between the several different tables. Thus, the cutting blade can be operating upon a layup on one of the cutting tables while layups are being formed on or cut pattern pieces are being removed from the other tables. Apparatus for transferring the cutting machine between the plurality of such tables is disclosed in U.S. Pat. No. 3,776,074 having the same assignee as the present invention.

Another solution which increases the utilization of the cutting machine comprises pre-forming of the layups at a position remote from the cutting table and moving the layup onto the cutting table in its preformed condition. The present invention is directed to this solution.

It is, accordingly, a general object of the present invention to provide a method and apparatus for placing a pre-formed layup of limp sheet material on the support surface of a cutting table in preparation for a cutting operation.

SUMMARY OF THE INVENTION

The present invention resides in a method and apparatus for placing pre-formed layups of limp sheet material in proper position on a surface of a work table such as a cutting table having a numerically controlled cutting head.

The apparatus which carries out the method of the invention includes a lay table having a support surface on which a multi-ply layup of the sheet material is supported as the layup is formed or spread. In forming the layup, one ply is laid on top of another until a layup of a desired thickness has been formed. The lay table is positioned adjacent to the work table on which the layup is eventually placed. The support surfaces of the lay table and the work table are also in adjacent relationship and preferably are in abutment so that a continuous support surface is defined by both tables.

A sled comprised principally of a flat member is laid on the support surface of the lay table prior to the spreading of a layup so that the flat member is interposed between the support surface and the layup when spread. After formation of the layup, the sled with the layup thereon is slidden over the support surfaces of the lay and work tables and into a desired position on the work table. Drive means such as a set of motor-driven cables extending between the tables is coupled to the sled by suitable means so that the layup can be pulled between the work and lay tables.

Once the layup is in its proper or desired position on the work table, it is clamped in position by suitable mechanism independently of the sled, and the sled is withdrawn from between the layup and support surface of the work table so that suitable work operations can be performed on the layup without interference from or damage to the sled.

The invention is advantageous since it permits one or more layups to be formed during the working of a previously formed layup, and hence, increases the potential operating time of the work table.

DESCRIPTION OF THE PREFERRED EMBODIMENTS

Figure 1:
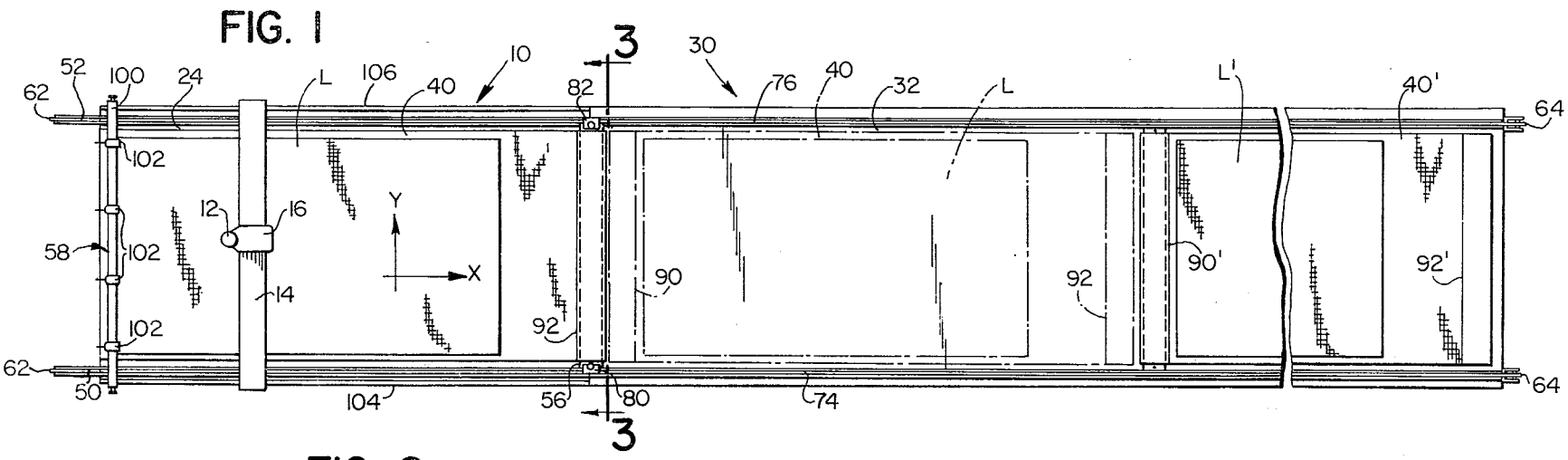
FIG. 1 is a plan view of a cutting table and a lay table constructed and utilized in accordance with the present invention.
Figure 2:
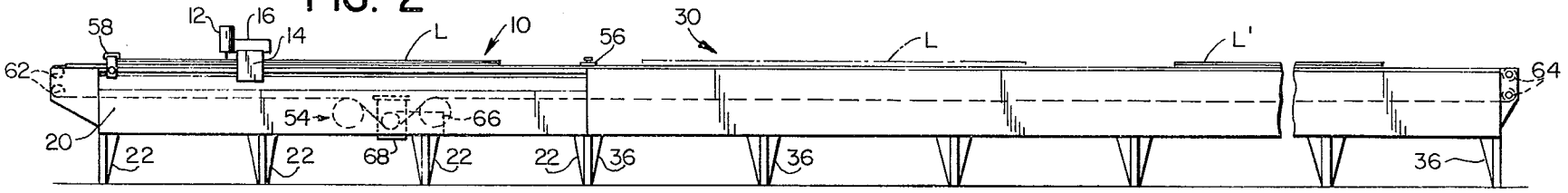
FIG. 2 is a side elevation view of the cutting table and lay table in FIG. 1.

FIGS. 1 and 2 illustrate a cutting table, generally designated 10, on which multi-ply layups L of limp sheet material are held in a cutting operation so that pattern pieces for garments, upholstery or other end products may be cut in multiple numbers. The type of material cut may be woven or nonwoven fabrics, paper, cardboard, plastics or other synthetic materials.

The table 10 has a cutting tool head 12 suspended over the layup L by an X-carriage 14 and Y-carriage 16 to move the tool head 12 in the X and Y coordinate directions respectively. The cutting tool in the head 12 is for example, a reciprocating knife blade which is also lifted in and out of cutting emgagement with the layup so that the complete periphery of a pattern piece can be cut, and the blade can then be moved to another pattern piece without cutting material between the two pieces. In situations where the tool is a reciprocating blade, the blade is also rotated about its axis of reciprocation to maintain tangency along the pattern piece contours which define the cutting paths through the layup.

The cutting table 10 has a stationary bed 20 held on a plurality of legs 22, and the bed defines the support surface 24 on which the layup L rests during a cutting operation. In one form of the cutting table 10, the support surface 24 is a penetrable surface defined by the upper ends of a plurality of bristles 28 as shown in greater detail in FIG. 3. With a penetrable surface of this type, the reciprocating cutting blade cuts completely through the layup into the bed without damaging the blade or bristles, and the bristles themselves define a generally porous and penetrable bed in which a vacuum may be generated to hold and compress the layup on the support surface. For a more detailed explanation of a penetrable bed and cutting table of this type, reference may be had to U.S. Patent 3,765,289 having the same assignee as the present invention.

In accordance with the present invention, a lay table, generally designated 30, in FIGS. 1 and 2 is positioned adjacent one end of the cutting table 10 and is provided with a flat support surface 32 on which the multi-ply layups are spread either manually or by spreading equipment such as disclosed in the reference U.S. Pat. No. 3,495,492. The support surface 32 is rigidly located in the same horizontal plane as the support surface 24 by means of the legs 36 of the lay table. Furthermore, the lay table 30 is placed in abutting relationship with the one end of the cutting table 10, and the support surface 32 extends substantially up to, and preferably completely to, the support surface 24 of the cutting table 10 so that a continuous support surface is defined between the left end of the cutting table and the right end of the lay table as viewed in FIGS. 1 and 2.

In accordance with the apparatus and method of the present invention, a sled 40 which is basically a flat or planar member, is first located in the phantom position on the support surface 32 remotely of the support surface 24 of the cutting tables, and a layup L of limp sheet material is spread on the upwardly exposed surface of the sled on the lay table 30. When the layup has been completely formed on the lay table, it is moved by means of the sled onto the support surface 24 of the cutting table and into the desired cutting position illustrated in FIGS. 1 and 2 where the cutting operation takes place. However, before the cutting operation begins, the sled 40 is withdrawn from between the penetrable support surface 24 and the layup so that the reciprocating cutting blade does not penetrate the sled, and neither the sled nor the blade is damaged during the cutting operation. Preferably, the sled is returned to the phantom position on the surface 32 of the lay table so that another layup can be generated during the period of time in which the cutting operation takes place upon the cutting table 10. If desired, the lay table 30 may be elongated to provide a support surface 32 which allows one or more additional layups L′ to be formed on additional sleds 40′ in preparation for subsequent cutting operations and then be moved on the sleds 40′ respectively into the phantom position on the lay table when the position is clear. It will be understood that the length of the lay table 30 in the longitudinal or X-direction illustrated should be selected to allow the number of layups generated in a given period of time to substantially match the number of layups that can be cut in the same time period.

The apparatus which carries out the above described method of the present invention includes, in addition to the sled 40, cables 50 and 52 extending between the cutting table 10 and the lay table 30, a cross-drive mechanism 54 below the cutting table for driving the cables 50 and 52 in synchronized relationship, an elongated and rigid tow bar 56 for coupling the sled 40 to the cables 50 and 52 and a clamp mechanism 58 for holding the layup L in the desired position on the surface 24 of the cutting table while the sled 40 is withdrawn from between the layup and support surface.

The cables 50 and 52 are each endless cables and are mounted on idler pulleys 62 at the left end of the cutting table and idler pulleys 64 at the right end of the lay table as illustrated in FIGS. 1 and 2. Each cable is supported by the pulleys in a closed path so that an upper portion extends close to or in the plane of the support surfaces 24 and 32 of the tables, and a lower portion feeds through the drive mechanism 54. The drive mechanism 54 includes a reversible motor 66 which is connected in driving relationship with the cables by means of a transmission 68 having a rotated drive shaft extending transversely under the cutting table 10 parallel to the Y-coordinate axis to engage both of the cables. In one embodiment of the invention, the drive cables 50 and 52 include chain sections 70 and 72 respectively shown in FIG. 3, and the chain sections are engaged respectively by a drive sprockets fixed to the cross-drive shaft of the transmission 68. Thus, synchronized movement of the cables 50 and 52 in the X-coordinate direction is assured.

Figure 3:
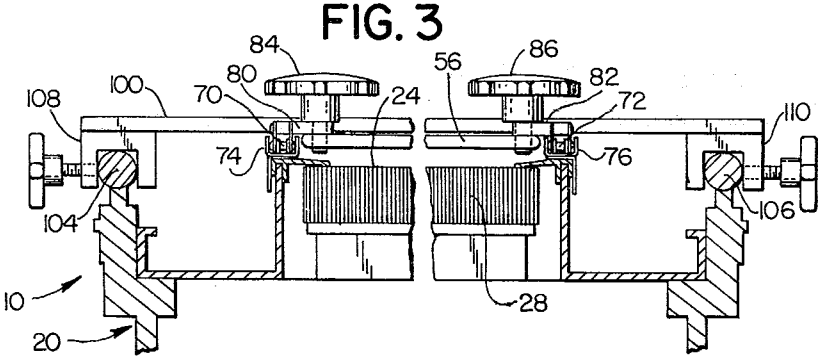
FIG. 3 is an enlarged cross-sectional view of the cutting table as viewed along the sectioning line 3—3 in FIG. 1.

A U-shaped channel 74 shown in FIG. 3 extends in the X-coordinate direction along one lateral side of the cutting and lay tables between the opposite ends of the tables. The channel is located close to the plane of the support surfaces 24 and 32 and serves as a track for guiding the upper portion of the cable 50 and preventing the cable form shifting in the Y- or lateral direction. A similar U-shaped channel 76 also shown in FIG. 3 extends along the opposite lateral side of the cutting and lay tables near the support surfaces and serves as a track for guiding the upper portion of the cable 52. Both U-shaped channels are shallow to produce a low profile over which the X-carriage passes. The channels are secured to the edges of the tables and open upwardly so that the two bar 56 can be connected to the cables and translated with the cables between the left end of the cutting table and the right or opposite end of the lay table as shown in FIGS. 1 and 2.

As shown in detail in FIG. 3, the tow bar 56 is connected to the chain sections 70 and 72 of the cables by means of chain brackets 80 and 82 and handscrews 84 and 86 respectively. It is readily apparent that by removing the handscrews, the tow bar is disconnected from the cables and thus the cables can be moved independently of the sled 40.

In a preferred embodiment of the invention, the sled 40 is comprised of a non-stretching, low friction, sheet-like material which slides readily over the support surfaces 24 and 32 of the cutting and lay tables. For example, limp, taffeta material made from a synthetic product marketed under the tradename Dacron or similar glossy, strong materials slide readily over even rough support surfaces with a layup thereon. It has been shown that taffeta with a layup spread thereon can be pulled over a support surface such as that formed by the upwardly projecting ends of the bristles 28. The material which forms the sled should be non-stretching so that the sheet material forming the layup is not stretched in the course of moving from the lay table to the cutting table. If any stretching of the sled were permitted, corresponding stretching of the layup would occur and would distort the finished configuration of the pattern pieces or produce wrinkles in the layup which interfere with accurate cutting of the pattern pieces.

In the embodiments of the invention in which the sled is formed by a rectangular piece of taffeta or similar material, loops 90 and 92 accommodating the tow bar 56 are sewn or otherwise formed respectively in the two edges of the sled extending transversely across the tables. Thus, the bar is laced through one of the loops and is fastened to the chain brackets 80 and 82 by means of the handscrews 84 and 86 to coupled the sled to the cables 50 and 52. Conversely, the bar is disconnected from the chain brackets and may be removed from the loops to disengage the sled from the cables.

When the layup L is to be moved from the lay table 30 to the cutting table 10, the tow bar 56 is laced through the loop 90 at the leading edge of the sled and is connected to the cables 50 and 52. The motor 66 is energized to pull the bar and the sled 40 with the layup thereon to the desired cutting position on the support surface 24. The tow bar 56 is then removed from the loop 90 and inserted through the loop 92 at the trailing edge of the sled as illustrated in FIGS. 1 and 2. The drive motor 66 is then driven in the reverse or opposite direction and moves the chain brackets 80 and 82 into adjacent relationship with the loop 92 so that the bar can again be coupled to the cables 50 and 52. The sled 40 may then be pulled and withdrawn from the position between the support surface 24 and the layup L.

To ensure that the layup L remains stationary in the desired position on the support surface 24 while the sled is withdrawn, the clamp mechanism 58 is attached to one edge of the layup as shown in FIG. 1. The clamp mechanism 58 is comprised of a rigid bar 100 which extends transversely across the cutting table and a plurality of clamps 102 distributed along the bar for engaging the layup independently of the sled 40. The number, spacing and width of the clamps utilized must be sufficient to restrain the layup without distortion or wrinkling when the sled 40 is withdrawn from under the layup. As shown most clearly in FIG. 3, the clamp bar 100 may be removably attached to roundways 104 and 106 by means of screw clamps 108 and 110 respectively. The roundways 104 and 106 may, for convenience, be the same ways on which the X-axis carriage 14 is mounted for traversing the cutting table in the illustrated X-coordinate direction. By permitting the clamp mechanism 58 to be attached to the roundways at any desired position along the cutting table, the layup L may correspondingly be positioned at any desired position. When the cutting tool 12 is operated, the clamping mechanism 56 is not needed, and accordingly, is removed to prevent any interference with the motions of the X-carriage 14.

If desired, the lay table 30 and the support surface 32 may be constructed with a longitudinal length permitting two or more layups to be spread or simultaneously located on the lay table in preparation for cutting. As shown in FIGS. 1 and 2, for example, the layup L′ is located at the exteme right-hand end of the lay table on a sled 40′. After a layup has been moved from the phantom position in FIGS. 1 and 2 onto the cutting table 10 and the sled 40 has been withdrawn from under the layup on the cutting table, a tow bar 56 is inserted through the loop 90 of the sled 40′ as shown and the chain brackets 80 and 82 are connected with the tow bar so that the cables 50 and 52 may pull the sled 40′ with the laybup L′ into the phantom position of the sled and layup immediately adjacent the cutting table 10. Then another sled 40′ is positioned on the right-hand end of the lay table and still another layup L is spread on the sled. Thus a complete layup is always positioned adjacent the cutting table in preparation for a subsequent cutting operation and one or more spreading operations can take place simultaneously with a cutting operation.

Figure 4:
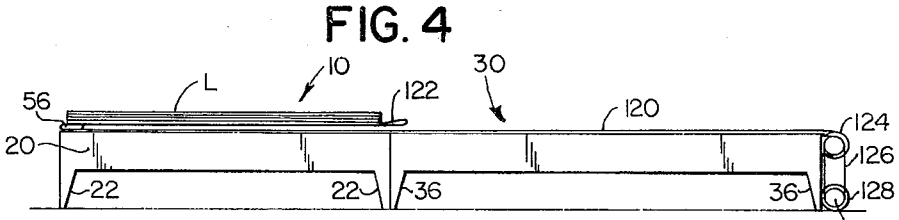
FIG. 4 is a side elevation view of the cutting table and lay table similar to that shown in FIG. 2 but in a simplified form and shows an alternate embodiment of the present invention.

FIG. 4 illustrates an alternate embodiment of the present invention. The cutting table 10 and the lay table 30 have substantially the same construction as in the embodiment of FIG. 1–3; however, the lengths of the tables are shortened, and the cutting tool, the carriages, the cables 50 and 52 and the drive mechanism 54 for the cables are not shown for simplicity.

In this embodiment of the invention, the sled on which the layup L is spread takes the form of an elongated strip 120 of limp sheet material such as the Dacron taffeta described above. The one end of the strip 120 has a loop 122 formed in it similar to the loops 90 or 92 formed in the sled 40 in FIG. 1. The opposite end of the strip is rolled onto a storage reel 124 rotatably mounted on the right-hand end of the lay table opposite the cutting table. The reel 124 is connected by a belt-pulley system 126 with a drive motor 128 through a one-way clutch 130.

Before a spreading operation, the one end of the strip 120 having the loop 122 is folded back over the adjacent portion of the strip on the cutting table so that a double-ply portion of the strip is located on the support surface of the cutting table. Then the layup L is spread on the exposed surface of the double-ply portion. The tow bar 56 is then laced through the double plies at the fold as shown and is connected with the cables 50 and 52 of FIG. 1 to pull the layup L and the double-ply portion onto the support surface of the cutting table 10 as shown in FIG. 4. As the layup is pulled, additional material forming the strip 120 is pulled from the reel 124. The one-way clutch 130 allows the reel 124 to rotate freely of the motor 128 during this step of the process and, hence, the motor is not energized. If necessary, the loop 122 may be clamped to the adjacent ply of the strip 120 to prevent any slippage between the two plies as the tow bar 56 pulls the layup onto the cutting table 10.

To remove the double-ply portion of the strip 120 from between the layup and the bed 20 of the cutting table 10, the tow bar 56 is removed, layup L is clamped by means of the clamping mechanism 58 (not shown) in the same manner as in FIG. 1 and the motor 128 is energized to pull the double-ply portion of the sled from under the layup and onto the lay table 30 and the storage reel 124. It will be observed during the withdrawal step that the fold in the strip 120 will effectively "roll" under the lowest ply of the layup L without any apparent relative movement or slippage between the lowest ply and the strip. Thus, there will not be any stretching or distortion of the material in the layup.

It will also be observed that the embodiment of the apparatus in FIG. 4 may be utilized in several different manners to load the layup onto the cutting table. If friction between the sled and the support surface of the cutting table is more critical than friction between the layup L and the sled, the end of the sled bearing the loop 122 may be folded under, rather than over, the adjacent portion of the strip, and when the strip is withdrawn from between the layup and cutting table, the "rolling" action will effectively eliminate any relative movement or slippage between the support surface of the cutting table and the sled. The same effect can be achieved by folding the end of the strip having the loop 122 on top of the strip as shown and utilizing the tow bar 56 to remove the double-ply portion from under the layup. In this latter case, the drive motor 128 is not utilized.

The embodiment of FIG. 4 can also be utilized without folding the strip 120 to form the double-ply portion. In such case, the tow bar 56 is laced through the loop 122 to pull the layup onto the cutting table and the motor 130 is utilized to withdraw the strip from under the layup.

Figure 6:
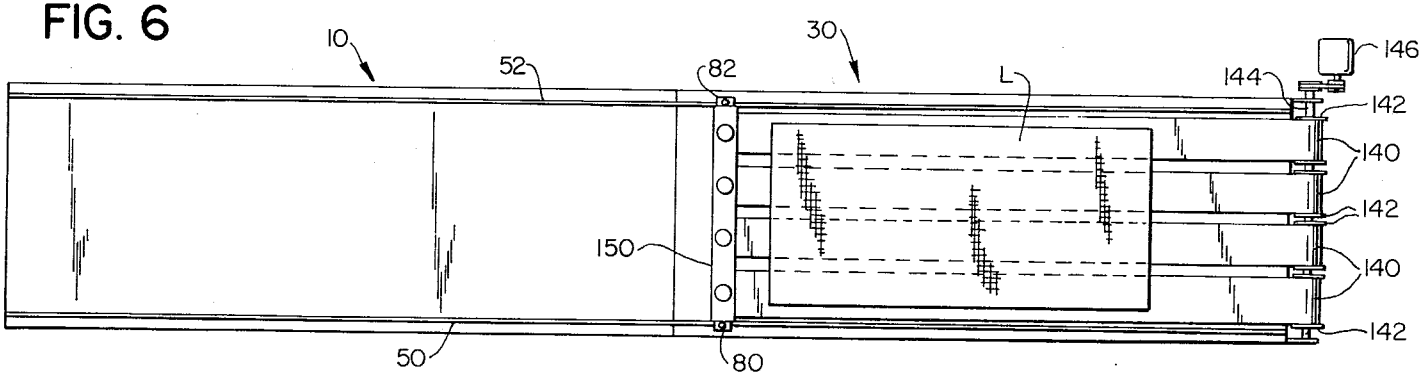
FIG. 6 is a plan view of the cutting and lay table in FIG. 5.
Figure 5:
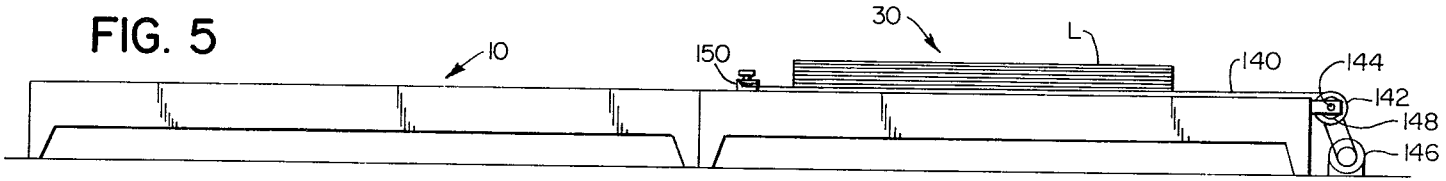
FIG. 5 is a side elevation view of the cutting and lay table similar to FIG. 4 and shows still another embodiment of the invention.

FIGS. 5 and 6 illustrate still another embodiment of the present invention. The cutting table 10 and the lay table 30 are illustrated in substantially the same abbreviated form as in FIG. 4. Thus, the cutting tool 12, the carriages 14 and 16, and the drive mechanism 54 for the cables are not shown.

In this embodiment of the invention, the sled on which the layup L is spread and moved onto the cutting table 10 takes the form of a plurality of flexible, sheet-like strips or tapes 140 of a polished metal such as stainless steel or a metal coated with a low friction material such as that marketed under the tradename Teflon. Each tape 140 may, for example, have a width ranging from 3 to 12 inches (7.5 - 30 cm) and a thickness ranging from 0.005 inch to 0.020 inch (0.13 - 0.51 mm).

Like the stip 120 in FIG. 4, each tape has one end which is wound on a storage reel and the reels for all of the tapes are mounted on the drive shaft 144 supported at the extreme righthand end of the lay table opposite the cutting table. A drive motor 146 is connected in driving relationship with the shaft 144, and interposed between the drive shaft and each reel 142 is an electrically or otherwise engaged clutch 148 which permits the reels to be driven singly or in selected groups from the drive shaft 142 by the motor 146. When the clutches are disengaged, the reels are free to rotate on the drive shaft and thus the tapes 140 may be pulled onto the support surfaces of the cutting and lay tables.

As shown in FIG. 6, each of the tapes 140 is initially pulled onto the support surface of the lay table 30 so that the tapes are side-by-side and in parallel relationship with the direction in which the layups are moved between the tables 10 and 30. A layup is then spread on the exposed surfaces of the tapes. The free ends of the tapes opposite the ends on the reels 142 are also jointed to a rigid clamping bar 150 which extends laterally across the cutting table perpendicular to the direction of movement and which connects with the chain brackets 80 and 82 on the cables 50 and 52 respectively in the same manner as the tow bar 56 in the embodiments of FIGS. 1–4. The clamping bar 150 may include a plurality of individual clamps which separately capture the free ends of the tapes between the clamping jaws or may comprise a bar having a single set of clamping jaws which close collectively on all of the tapes. The free end of each tape is preferably flat and without any protrusions for subsequent withdrawal from under the layup and; therefore, the jaws of the clamping bar 150 must develop sufficient clampingforces to prevent the otherwise smooth ends of the tape from escaping from the jaws while the layup is pulled onto the cutting table. The drive mechanism for the cables 50 and 52 is then energized and the clamping bar 150 pulls each of the tapes together with the layup spread thereon over the support surface of the lay table and onto the support surface of the cutting table to a desired cutting position. Once the layup is in the desired position, the clamping bar 150 is released from the free ends of the tapes 140 and the tapes are withdrawn from between the layup and support surface of the cutting table by means of the drive shaft 144 and the drive motor 146. The clutches 148 which couple the reels 142 to the drive shaft 144 are not operated. simultaneously, but, instead are engaged selectively to allow only one or two of the tapes to be withdrawn at one time.

The principal advantage of the sled formed from the plurality of the tapes 140 as shown in FIGS. 5 and 6 is the ability to withdraw the tapes individually or only a few at a time and, thusly, substantially reduce the propensity for stretching the layup while the sled is being withdrawn. With the sled divided into a number of tapes and by withdrawing tapes individually, the friction between the layup and the remaining tapes or between the layup and the support surface of the table 10 holds all of the fabric in place. The requirement for the clamping mechanism 58 of FIG. 1 and 2 to hold the layup may be eliminated in circumstances where the friction forces are adequate to hold the layup. Stretching of the layup with the taffeta material mentioned above is not a problem when the layups formed are not particularly heavy; however, for heavier materials and deeper layups which produce greater pressures between the sled and the support surfaces of the cutting and lay tables, the multiple-tape form of the sled is preferred. The polished sheet metal tapes also reduce the pulling loads when relatively long layups are being pulled onto the cutting table.

Thus, apparatus and method have been disclosed in several different embodiments for placing a pre-formed layup of limp sheet material on a cutting table. The apparatus and method have special utility with an automatically controlled cutting machine such as described since they allow layups to be spread during the course of a cutting operation and permit the pre-formed layups to be moved immediately on the the cutting table after previously cut pieces have been removed. Thus, the utility of the cutting machine is enhanced by eliminating the spreading time between successive cutting operations.

While the present invention has been described in several embodiments, it should be understood that still further modifications and substitutions can be had without departing from the spirit of the invention. For example, although the invention has been disclosed in connection with a cutting table, it has utility with numerous other work tables having tools which operate upon layups of sheet material. Furthermore, although only one lay table has been shown adjacent one end of the cutting table, it is contemplated that another lay table may be located adjacent the opposite end of the cutting table. The cables 50 and 52 then extend over both the cutting table and the two lay tables, and preformed layups are pulled onto the support surface of the penetrable cutting bed from either end of the cutting table. Accordingly, the invention has been described in several preferred embodiments by way of illustration rather than limitation.

I claim:

1. In combination with a cutting machine having a table defining a support surface for holding sheet material in a multi-ply layup while a cutting tool cuts through the material, the improvement comprising:

a lay table positioned adjacent a selected side of the cutting table and having a support surface located to form an extension of the support surface of the cutting table;

a storage reel connected for rotation to the lay table;

an elongated planar member having one end rolled on the storage reel and an opposite end extending from the storage reel over the support surface of the lay table toward the cutting table from a side of the lay table remotely opposite the selected side of the cutting table, the elongated planar member having a length sufficient to reach from the storage reel across the support surfaces of the adjacent lay and cutting tables, the planar member also being slidable between the cutting and lay tables on the support surfaces of the tables and having an exposed surface area on which a layup of sheet material may be spread; and motor means engageable in driving relationship with said opposite end of the planar member for drawing the elongated member and a layup spread thereon between the support surfaces of the tables.

2. The improvement of claim 1 further including:

cabling means extending between the cutting table and the lay table and being movable between the tables and relative to the support surfaces; and wherein said opposite end of the elongated planar member is selectively engageable with the cabling means for movement over the support surfaces between the tables by the cabling means; and the motor is connected in driving relationship with the cabling means for pulling the planar member with a layup spread thereon from the support surface of the lay table onto the support surface of the cutting table.

3. The improvement of claim 2 wherein:

the support surfaces of the cutting and lay tables lie substantially in a common plane; and a track extends between the tables adjacent the support surfaces and in substantially the same common plane as the support surfaces; and the cabling means includes one cable which lies in the track as the motor pulls the flat member between the tables.

4. The improvement of claim 2 wherein:

two parallel tracks extend between the cutting and lay tables on opposite sides of the support surfaces; and the cabling means includes two cables which lie respectively in the parallel tracks

5. The improvement of claim 4 wherein:

the cutting table and the lay table abut in end-to-end relationship and include pulleys at the table ends opposite the ends in abutting relationship; and the two cables are endless loops respectively and are mounted on the pulleys at the opposite ends of the table.

6. The improvement of claim 1 further including:

clamping means for engaging a layup on the planar member independently of the planar member and for holding the layup stationary relative to the supporting surfaces to permit the planar member to be pulled out from under the layup.

7. The improvement of claim 1 including rotary drive means connected with the storage reel for rotating the reel to withdraw the elongated planar member from under a layup and onto the reel.

8. The improvement of claim 1 wherein the elongated planar member comprises a sheet of limp fabric material.

9. The improvement of claim 1 wherein the elongated planar member comprises a piece of flexible sheet material.

10. In combination with a cutting machine having a table defining a support surface for holding sheet material in a multi-ply layup while a cutting tool cuts through the material, the improvement comprising:

a lay table positioned adjacent the cutting table and having a support surface located to form an extension of the support surface of the cutting table;

a plurality of similar elongated planar members slidable in side-by-side and parallel relationship between the cutting and lay tables on the support surfaces of the tables, each member having an exposed surface area on which a layup of sheet material may be spread; and motor means engageable in driving relationship with the planar members for moving the members and a layup spread thereon between the support surfaces of the tables.

11. In combination with a cutting machine having a cutting table on which sheet material is held in a spread condition during cutting, apparatus for loading preformed layups of sheet material onto the support surface of the cutting table comprising:

a lay table having a support surface on which a multi-ply layup of the sheet material is supported as the layup is spread, the lay table being positioned adjacent to the cutting table with the support surfaces of the tables in adjacent and substantially continuous relationship whereby a substantially continuous supporting surface is defined by the tables;

a sled having a flat member formed by a sheet of limp, non-stretching, low friction material which is interposed between the layup and the support surface of the lay table during spreading and which is slidable with the layup thereon between the lay table and the cutting table on the support surfaces of the tables;

drive means having a driven member movable between the lay and work tables; and coupling means for connecting the flat member of the sled with the driven member of the drive means for sliding the sled with a layup thereon between the lay and cutting tables.

* * * * *